US008740376B2

(12) United States Patent
Iijima

(10) Patent No.: US 8,740,376 B2
(45) Date of Patent: Jun. 3, 2014

(54) RECORDING APPARATUS

(71) Applicant: Seiko Epson Corporation, Tokyo (JP)

(72) Inventor: Takayuki Iijima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/647,041

(22) Filed: Oct. 8, 2012

(65) Prior Publication Data

US 2013/0100218 A1 Apr. 25, 2013

(30) Foreign Application Priority Data

Oct. 24, 2011 (JP) ..... 2011-232558

(51) Int. Cl.
*B41J 2/01* (2006.01)

(52) U.S. Cl.
USPC ..... 347/102

(58) Field of Classification Search
USPC ..... 347/25, 102, 104
See application file for complete search history.

(56) References Cited

U.S. PATENT DOCUMENTS

| | | | | |
|---|---|---|---|---|
| 3,700,218 | A * | 10/1972 | Laisney | 432/62 |
| 3,806,314 | A * | 4/1974 | Obuchi et al. | 432/230 |
| 4,981,433 | A * | 1/1991 | Matsumoto et al. | 432/59 |
| 6,219,128 | B1 * | 4/2001 | Denawa et al. | 355/27 |
| 6,390,618 | B1 * | 5/2002 | Wotton et al. | 347/102 |
| 2009/0189337 | A1 | 7/2009 | Yamamoto | |

FOREIGN PATENT DOCUMENTS

JP 2009-179415 8/2009

* cited by examiner

*Primary Examiner* — Anh T. N. Vo
(74) *Attorney, Agent, or Firm* — Workman Nydegger

(57) ABSTRACT

An ink jet printer includes a liquid recording head that is arranged at a halfway position of a transportation path of a sheet to be transported to a downstream side from an upstream side, and performs surface print processing by adhering ink to a surface of the sheet, a drying device that is arranged so as to be spaced from the liquid recording head on the transportation path, and an exhaust fan that generates airflow for suppressing heat transfer from the drying device to the liquid recording head between the liquid recording head and the drying device.

5 Claims, 6 Drawing Sheets

RECORDING APPARATUS

CROSS-REFERENCE TO RELATED APPLICATIONS

This application claims priority to Japanese Patent Application No. 2011-232558 filed on Oct. 24, 2011. The entire disclosures of Japanese Patent Application No. 2011-232558 is hereby incorporated herein by reference.

BACKGROUND

1. Technical Field

The present invention relates to a recording apparatus such as an ink jet printer, for example.

2. Related Art

In general, an ink jet printer has been widely known as a recording apparatus which performs liquid record processing by adhering liquid to a target by a liquid recording unit. As such printer, an existing printer as disclosed in JP-A-2009-179415 has been known.

In the printer as disclosed in JP-A-2009-179415, printing is performed by ejecting ink (liquid) onto a sheet (target) to be transported to the downstream side from the upstream side through nozzles of a print head (liquid recording unit). Further, printing is performed on a surface of the sheet, which is opposite to the surface (recording surface) on which printing has been performed, by a back surface printing unit. And then, the sheet is dried by blowing dry air (hot air) onto the sheet by a drying device (heat source) at the downstream side.

In the printer as disclosed in JP-A-2009-179415, the back surface printing unit is arranged between the print head and the drying device on a transportation path of the sheet. However, since nothing shields the dry air, the dry air (hot air) blown out from the drying device flows to the print head along the transportation path of the sheet. As a result, the print head is heated by the dry air so that an ejection state of ink to be ejected through the nozzles is changed, resulting in a problem that print quality of the target is lowered.

SUMMARY

An advantage of some aspects of the invention is to provide a recording apparatus which can suppress heating a liquid recording unit with heat of a heat source.

A recording apparatus according to an aspect of the invention includes a liquid recording unit that is arranged at a halfway position of a transportation path of a target to be transported to a downstream side from an upstream side, and performs liquid record processing by adhering liquid to the target, a heat source that is arranged so as to be spaced from the liquid recording unit on the transportation path, and an airflow generation unit that generates airflow for suppressing heat transfer from the heat source to the liquid recording unit between the liquid recording unit and the heat source.

According to the aspect of the invention, airflow for suppressing heat transfer from the heat source to the liquid recording unit is generated between the liquid recording unit and the heat source. This makes it possible to suppress heating the liquid recording unit with heat of the heat source.

In the recording apparatus according to the aspect of the invention, it is preferable that the airflow generation unit be a discharging unit that is arranged at an outer side of the transportation path in a direction orthogonal to a transportation direction of the target and discharges air between the liquid recording unit and the heat source on the transportation path to the outside of the transportation path.

According to the aspect of the invention, the air between the liquid recording unit and the heat source on the transportation path, which is heated by the heat source and flows to the liquid recording unit along the transportation path, can be discharged to the outside of the transportation path by the discharging unit.

In the recording apparatus according to the aspect of the invention, it is preferable that a holding member which holds a recording surface of the target as a surface on which the liquid record processing is performed and has a strike receiving surface for receiving impact of striking through the target when striking record processing by the striking is performed on a surface opposite to the recording surface, and a cover member which covers the holding member and has a first opening at a side of the heat source in the transportation direction of the target be provided between the heat source and the liquid recording unit on the transportation path, and a second opening be provided at at least an end of the cover member at a side corresponding to the discharging unit in both ends in the direction orthogonal to the transportation direction of the target.

According to the aspect of the invention, the air which is heated by the heat source flows into the cover member through the first opening and heats the holding member, and then, flows out of the cover member through the second opening and is discharged by the discharging unit. Therefore, the holding member can be heated by the air heated by the heat source and the heated air flowing to the liquid recording unit can be suppressed.

It is preferable that the recording apparatus according to the aspect of the invention further include an exhaust duct that introduces the air which is discharged to the outside of the transportation path by the discharging unit to the exterior, and the exhaust duct extend from the discharging unit in a direction of being farther from the liquid recording unit.

According to the aspect of the invention, the air heated by the heat source can be reliably made to be farther from the liquid recording unit by the exhaust duct.

In the recording apparatus according to the aspect of the invention, it is preferable that the heat source be a drying unit which blows heated air onto the target on which the liquid record processing has been performed by the liquid recording unit to dry the target, and the exhaust duct be arranged so as to be adjacent to the drying unit in the direction orthogonal to the transportation direction of the target.

According to the aspect of the invention, the air heated by the drying unit flows in the exhaust duct so that the exhaust duct is heated and a part of heat of the heated exhaust duct returns to the drying unit. Therefore, drying efficiency of the drying unit can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
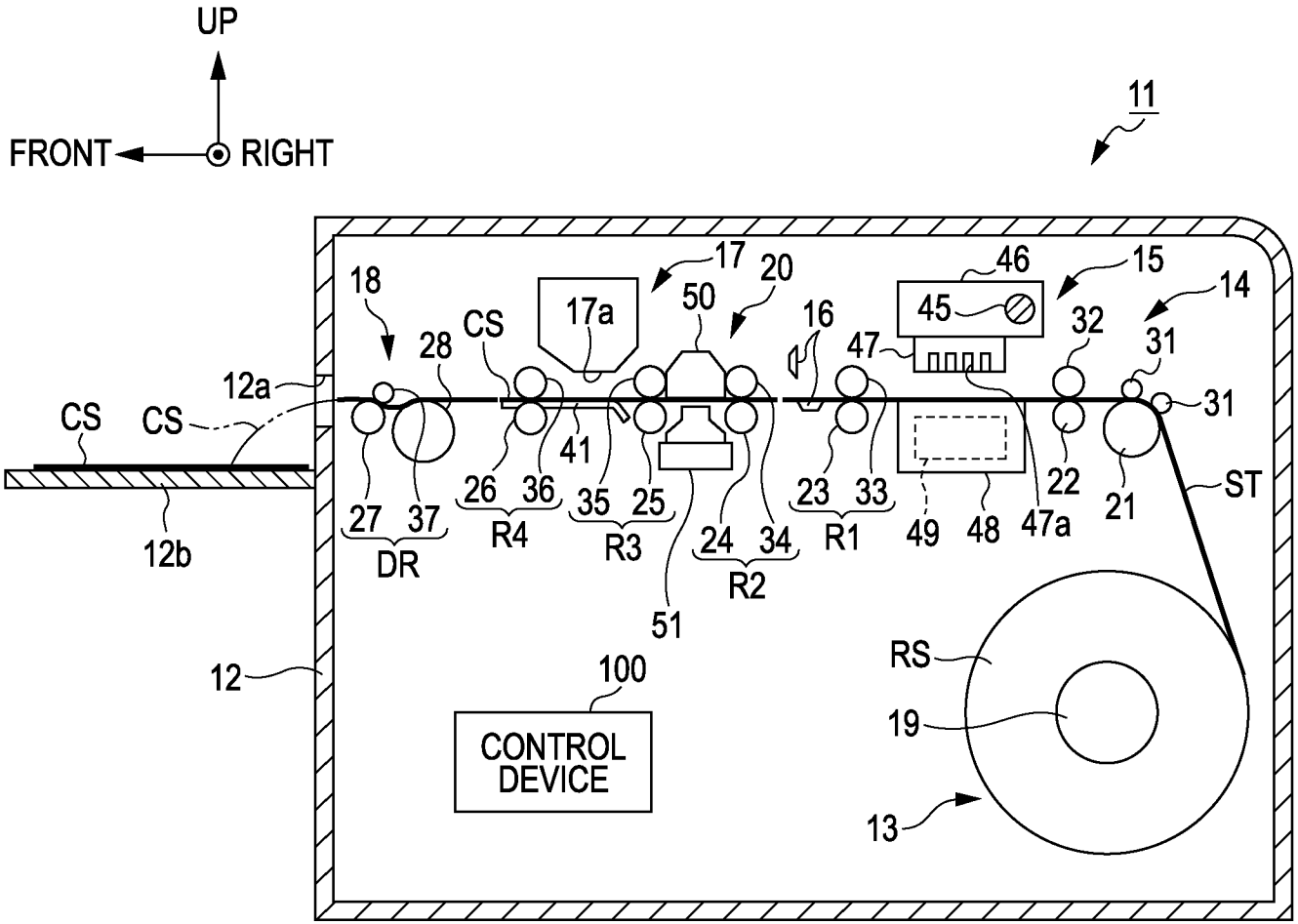
FIG. 1 is a side view schematically illustrating an ink jet printer according to an embodiment.

Hereinafter, an embodiment in which a recording apparatus according to the invention is embodied into an ink jet printer is described with reference to the drawings. In the following description, the "front-rear direction", the "right-left direction", and the "up-down direction" to be referred indicate the front-rear direction, the right-left direction, and the up-down direction as indicated by arrows in the drawings, respectively. It is to be noted that a mark of "•" in "○" in each of the arrows indicating the upper direction, the right direction, and the front direction in the drawings (drawing when the point of an arrow is seen from the front side) means an arrow toward the surface side from the back surface side of a paper plane.

As illustrated in FIG. 1, an ink jet printer 11 as a recording apparatus includes a main body case 12 having a substantially rectangular parallelepiped shape. A sheet discharge port 12*a* and a substantially horizontal plate-like sheet discharge portion 12*b* are provided on a front wall of the main body case 12. The sheet discharge port 12*a* makes the outer side and the inner side of the main body case 12 communicate with each other. A cut sheet CS after print processing, which has been discharged from the sheet discharge port 12*a*, can be placed on the sheet discharge portion 12*b*. A sheet feeding portion 13 on which a roll body RS is mounted is provided on a rear end lower portion in the main body case 12. The roll body RS is obtained by winding a long sheet ST (for example, continuous sheet) in a roll form.

Further, a transportation mechanism 14 is included in the main body case 12. The transportation mechanism 14 transports the sheet ST along a transportation path extending toward the sheet discharge portion 12*b* from the sheet feeding portion 13. In addition, a surface recording portion 15 and a cutter 16 are provided in the main body case 12. The surface recording portion 15 performs surface print processing as liquid record processing of ejecting and adhering ink as liquid onto the surface of the sheet ST on a halfway position of the transportation path. The cutter 16 cuts the sheet ST after the surface print processing into a cut sheet CS (single sheet) having a predetermined length.

A back surface recording portion 20 is provided on the transportation path of the sheet ST at the downstream side of the cutter 16. The back surface recording portion 20 performs back surface print processing as striking record processing of printing on a surface (back surface) of the cut sheet CS, which is opposite to the recording surface (surface) on which the surface print processing has been performed, by striking. Further, a drying device 17 is provided on the transportation path of the sheet ST at the downstream side of the back surface recording portion 20 so as to be adjacent to the back surface recording portion 20 along the transportation path. The drying device 17 as a drying unit (heat source) blows hot air (heated air) onto the recording surface (surface) of the cut sheet CS on which the surface print processing has been performed so as to dry ink. That is to say, the drying device 17 is arranged so as to be spaced from the surface recording portion 15 on the transportation path of the cut sheet CS.

Further, a curl correcting mechanism 18 is provided on the transportation path of the sheet ST at the downstream side of the drying device 17. The curl correcting mechanism 18 corrects curl (curling tendency) of the cut sheet CS. The curl correcting mechanism 18 includes a transporting function in addition to a curl correcting function, and constitutes a part of the transportation mechanism 14. It is to be noted that in the embodiment, the sheet ST and the cut sheet CS constitute a target.

As illustrated in FIG. 1, the sheet feeding portion 13 includes a rotating shaft 19 and a feeding motor (not illustrated). The rotating shaft 19 supports the roll body RS in a rotatable manner. The feeding motor makes the rotating shaft 19 rotate. Further, the rotating shaft 19 rotates in the counter-clockwise direction in FIG. 1 with the feeding motor driving so that the sheet ST is fed to the downstream side of the transportation path of the sheet ST from the roll body RS.

The transportation mechanism 14 includes a plurality of transportation rollers 21 to 28, a transportation motor (not illustrated), and driven rollers 31 to 37. The plurality of transportation rollers 21 to 28 transport the sheet ST or cut sheet CS from the upstream side to the downstream side of the transportation path and can be rotationally driven. The transportation motor serves as a driving source for rotationally driving the transportation rollers 21 to 28. The driven rollers 31 to 37 can nip and hold the sheet ST or cut sheet CS together with the transportation rollers 21 to 27.

Further, the driven rollers 31 to 37 are rotationally driven with the rotational driving of the transportation rollers 21 to 27 by the transportation motor (not illustrated) so that the sheet ST or cut sheet CS is transported from the upstream side to the downstream side of the transportation path. It is to be noted that a substantially flat plate-like transportation path formation member 41 is arranged at a position corresponding to the transportation roller 26. The transportation path formation member 41 constitutes a part of the transportation path and can support the sheet ST or cut sheet CS.

The curl correcting mechanism 18 constituting a part of the transportation mechanism 14 includes a transportation roller 28 having a large diameter and a decurl roller pair DR. The decurl roller pair DR is constituted by a transportation roller 27 and a driven roller 37 having small diameters. The decurl roller pair DR is arranged at the downstream side of the transportation path with respect to the transportation roller 28. Further, during printing, the curl correcting mechanism 18 moves the driven roller 37 constituting the decurl roller pair DR to a correcting position so as to perform curl correction processing on the cut sheet CS. The correcting position corresponds to a position at which a correcting force for making the cut sheet CS curve in the direction opposite to the curling direction is applied to the cut sheet CS.

In the following description, the transportation roller 23 and the driven roller 33 forming a pair are referred to as a transportation roller pair R1, the transportation roller 24 and the driven roller 34 forming a pair are referred to as a transportation roller pair R2, the transportation roller 25 and the driven roller 35 forming a pair are referred to as a transportation roller pair R3, and the transportation roller 26 and the driven roller 36 forming a pair are referred to as a transportation roller pair R4.

The surface recording portion 15 includes a guide shaft 45 and a carriage 46 at the upper side of the transportation path in the main body case 12. The guide shaft 45 is spanned in a state of horizontally extending along the width direction (right-left direction) orthogonal to the transportation direction (front direction) of the sheet ST or cut sheet CS. The carriage 46 is supported by the guide shaft 45 in a state capable of moving along the lengthwise direction (width direction) of the guide shaft 45.

A liquid recording head 47 as a liquid recording unit is mounted on the carriage 46 in a state of being opposed to the transportation path. A plurality of nozzles 47*a* for ejecting ink are provided on the liquid recording head 47. Accordingly, if the carriage 46 reciprocates along the scanning direction (right-left direction) while being guided by the guide shaft 45, the liquid recording head 47 reciprocates in the scanning direction (width direction of the sheet ST or cut sheet CS) together with the carriage 46.

Further, the surface recording portion 15 includes a supporting table 48 arranged at a position opposed to the liquid recording head 47 with the transportation path therebetween. The supporting table 48 incorporates a suction mechanism 49 for adsorbing the sheet ST through a plurality of suction holes (not illustrated) opened in the upper surface of the supporting table 48. Further, ink is ejected onto the surface (upper surface in FIG. 1) of the sheet ST supported by the supporting table 48 through the nozzles 47*a* of the liquid recording head 47. With this, surface print processing of adhering the ink to the sheet ST is performed.

To be more specific, the ink jet printer 11 receives print job data from a host apparatus (not illustrated). Further, if the print job data is input, a control device 100 included in the ink jet printer 11 divides print data included therein for each recording data corresponding to one scanning of the liquid recording head 47.

The liquid recording head 47 performs the surface print processing of ejecting ink through the nozzles 47*a* selected based on the recording data during one scanning of the carriage 46. Further, the sheet ST is transported to a subsequent surface print processing position between previous/following surface print processing for each scanning.

That is to say, in the surface recording portion 15, formation of a band-like image of which width direction corresponds to the lengthwise direction and intermittent transportation of the sheet ST are alternately repeated so that an image based on a print job is formed on the sheet ST. It is to be noted that on the transportation path from the surface recording portion 15 to the curl correcting mechanism 18, a virtual plane including the upper surface of the supporting table 48 and the upper surface of the transportation path formation member 41 corresponds to the transportation surface on which the sheet ST or cut sheet CS is transported during the printing.

Further, the sheet ST is cut by the cutter 16 in a state where the transportation of the sheet ST by the transportation mechanism 14 is stopped. The cutter 16 cuts substantially the center of a sheet portion of which both sides are held by the transportation roller pairs R1 and R2 while moving in the width direction (right-left direction) so as to separate the cut sheet CS from the sheet ST. It is to be noted that in the embodiment, the sheet ST is cut at a timing at which the transportation of the sheet ST is stopped in a process of the surface print processing.

The drying device 17 is arranged at an upper position of a region nipped between the transportation roller pairs R3 and R4 in the transportation direction. The drying device 17 blows hot air onto the surface (recording surface) of the cut sheet CS supported on the upper surface of the transportation path formation member 41 from an outlet 17*a* formed in the lower surface of the drying device 17 so as to perform dry processing of ink drying on the cut sheet CS.

In this case, the drying device 17 has a length corresponding to a maximum width of the cut sheet CS in the width direction (right-left direction). The outlet 17*a* is opened to have a substantially rectangular shape extending along the lengthwise direction (width direction) of the drying device 17 so as to have a length over an entire region of the cut sheet CS in the width direction. Accordingly, the drying device 17 can blow hot air onto the entire region of the cut sheet CS in the width direction from the outlet 17*a*. Further, temperature control and blown air control of the drying device 17 are performed by the control device 100 which controls an operation state of the ink jet printer 11 overall.

Next, a configuration of the back surface recording portion 20 is described in detail.

As illustrated in FIG. 1, the back surface recording portion 20 is located between the cutter 16 and the drying device 17 on the transportation path. The back surface recording portion 20 includes a holding unit 50 and a striking recording head 51. The holding unit 50 is arranged at the upper side of the transportation path and holds the surface of the cut sheet CS. The striking recording head 51 is arranged so as to be opposed to the holding unit 50 with the transportation path therebetween.

The striking recording head 51 is constituted as a so-called dot impact-type head which performs back surface print processing of striking while pressing an ink ribbon (not illustrated) against the back surface (lower surface) of the cut sheet CS so as to form ink dots.

Figure 2:
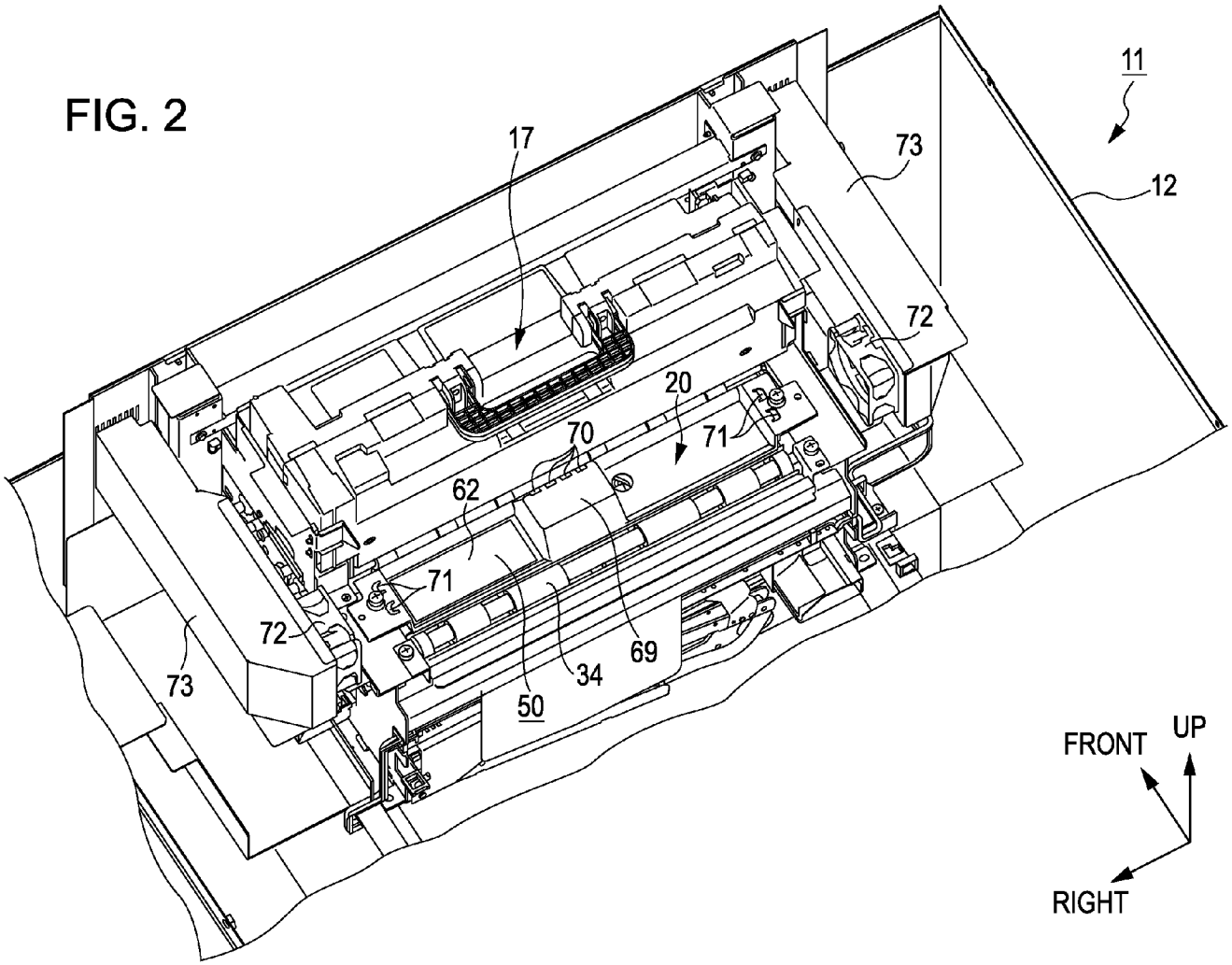
FIG. 2 is a perspective view illustrating a holding unit and peripherals thereof in the printer when seen from the rear side.
Figure 3:
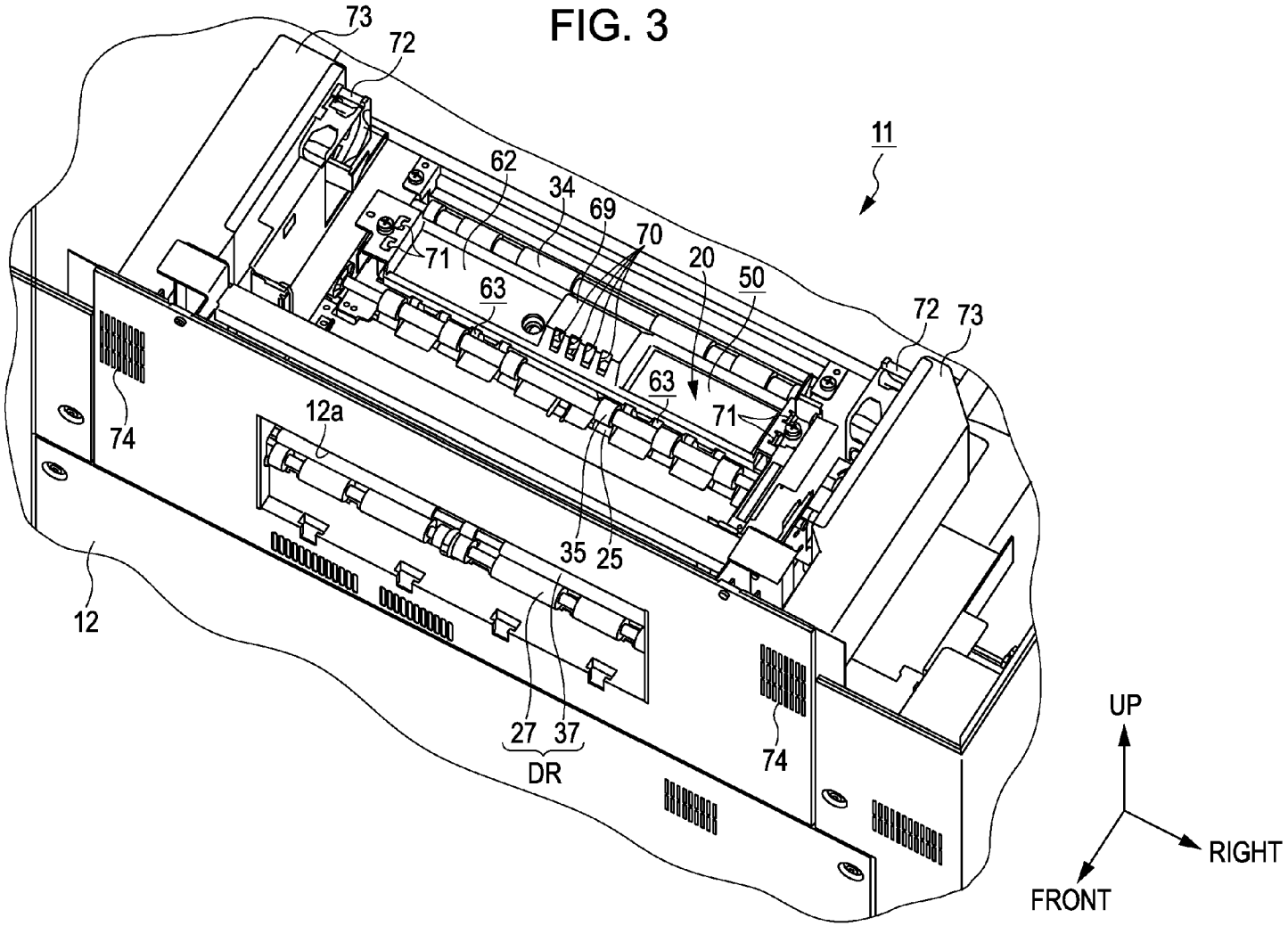
FIG. 3 is a perspective view illustrating the holding unit and peripherals thereof in the printer from which a drying device is removed when seen from the front side.
Figure 4:
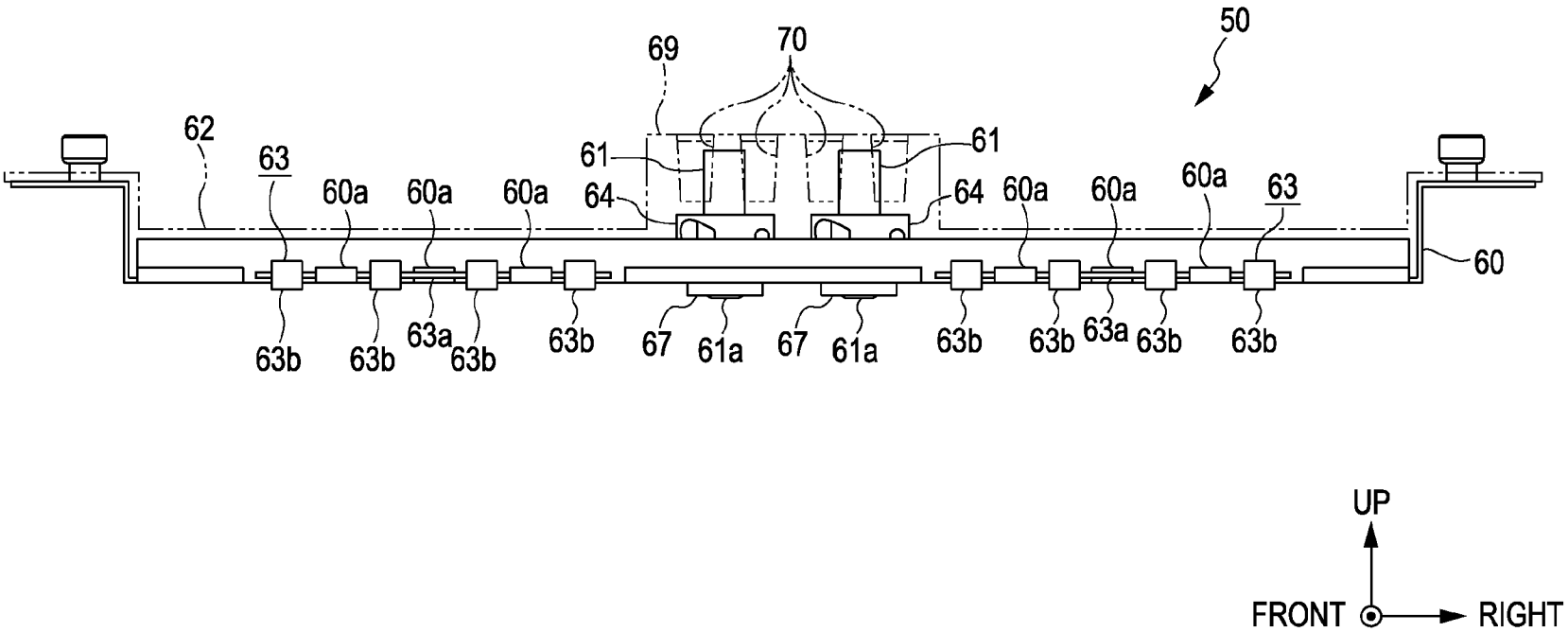
FIG. 4 is a front view illustrating the holding unit.

As illustrated in FIG. 2 through FIG. 4, the holding unit 50 includes a flat plate-like beam member 60, two holding members 61 made of a metal, and a cover member 62 made of a synthetic resin. The beam member 60 is spanned so as to extend in the right-left direction. The holding members 61 are attached to the center portion of the beam member 60 in the right-left direction and have columnar shapes. The cover member 62 covers the beam member 60 and the holding members 61 from the upper side.

Both of right and left ends of the beam member 60 are bent to the upper side at right angles, and then, are further bent to the outer sides at right angles in the right-left direction. Guide rollers 63 are supported in a rotatable manner on a front end edge portion of the beam member 60 at the outer sides with respect to the holding members 61 in the right-left direction. Note that the guide rollers 63 are supported so as to form pairs at the right and left sides. That is to say, each of the guide rollers 63 includes a rotating shaft 63*a* and four rollers 63*b*. The rotating shaft 63*a* is supported on a bearing portion 60*a* provided at the front end edge portion of the beam member 60 in a rotatable manner. The rollers 63*b* are supported on the rotating shaft 63*a* at a constant interval in a rotatable manner.

Further, each of the guide rollers 63 rotates by making contact with the cut sheet CS to be transported. With this, the guide rollers 63 reduce friction forces between the guide rollers 63 and the cut sheet CS after the back surface print processing so as to protect the cut sheet CS, and guide the cut sheet CS to the transportation roller pair R3 with high accuracy while suppressing warping of the cut sheet CS to the upper side.

Figure 6:
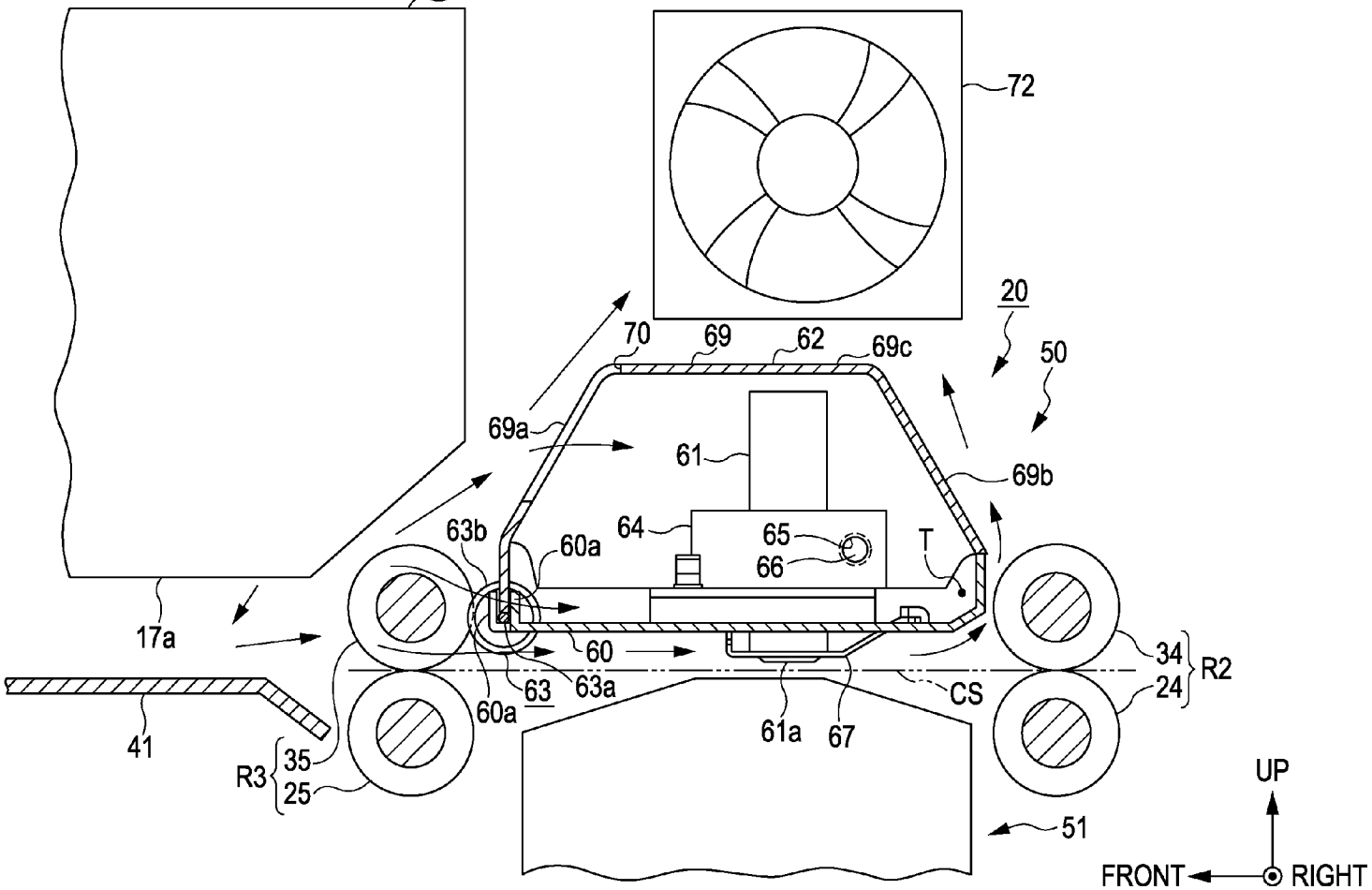
FIG. 6 is a side view schematically illustrating the holding unit and peripherals thereof in the printer.

As illustrated in FIG. 4 and FIG. 6, the holding members 61 are arranged so as to be aligned with the beam member 60 in the right-left direction and be slightly deviated therefrom in the front-rear direction. In this case, the holding members 61 are inserted through through-holes (not illustrated) formed in the beam member 60 such that lower end portions project to the lower side with respect to the lower surface of the beam member 60.

Further, circular arc-like adjusting members 64 are firmly fixed onto the beam member 60. The holding members 61 are inserted through the adjusting members 64 and height positions (positions in the up-down direction) of the holding members 61 can be adjusted by the adjusting members 64. A screw hole 65 extending in the right-left direction is formed in a peripheral wall of each of the adjusting members 64. A screw 66 is screwed into the screw hole 65.

Then, if the screws 66 are tightened, the adjusting members 64 restrict movement of the holding members 61 in the up-down direction. On the other hand, if the screws 66 are loosened, the adjusting members 64 allow the movement of the holding members 61 in the up-down direction. That is to say, the adjusting members 64 support the holding members 61 so as to adjust them to each desired height.

The lower surfaces of the holding members 61 correspond to strike receiving surfaces 61*a* which receive impact of striking by the striking recording head 51 through the cut sheet CS when the back surface print processing by the striking recording head 51 is performed on the back surface of the cut sheet CS in a state where the holding members 61 hold the surface of the cut sheet CS.

Guide frames 67 are provided on the lower surface of the beam member 60 at positions corresponding to the holding members 61 so as to surround the lower end portions of the holding members 61. The guide frames 67 guide the cut sheet CS to be transported along the transportation path to the strike receiving surfaces 61*a*. Circular through-holes (not illustrated) for exposing the strike receiving surfaces 61*a* of the holding members 61 to the lower side are formed in the guide frames 67.

The cover member 62 covers the upper side of the beam member 60 overall and has a shape corresponding to the beam member 60. Further, a passage T extending in the right-left direction is formed between the cover member 62 and the beam member 60 in a state where the cover member 62 covers the upper side of the beam member 60 overall. In addition, an accommodating portion 69 for accommodating the holding members 61 is provided at the center portion of the cover member 62 in the right-left direction, which corresponds to the holding members 61.

The accommodating portion 69 has a substantially square box shape of which lower side (beam member 60 side) is opened. The accommodating portion 69 is formed so as to swell up in comparison with portions of the cover member 62 other than the accommodating portion 69. An inner space of the accommodating portion 69 communicates with the passage T. A front wall 69*a* and a rear wall 69*b* of the accommodating portion 69 are inclined so as to be closer to each other toward the upper side in the front-rear direction. An upper wall 69*c* of the accommodating portion 69 is substantially horizontal.

A plurality of (in the embodiment, four) first openings 70 are formed in the accommodating portion 69 of the cover member 62 at positions on the side of the drying device 17. The first openings 70 make an inner side and an outer side of the accommodating portion 69 communicate with each other and are aligned at a constant interval in the right-left direction. The first openings 70 are arranged so as to correspond to the holding members 61 in the front-rear direction. The first openings 70 have substantially rectangular shapes extending from the center portion of the front wall 69*a* of the accommodating portion 69 in the up-down direction to a front end portion of the upper wall 69*c*. Further, widths of the first openings 70 in the right-left direction are gradually increased toward the upper side.

Figure 5:
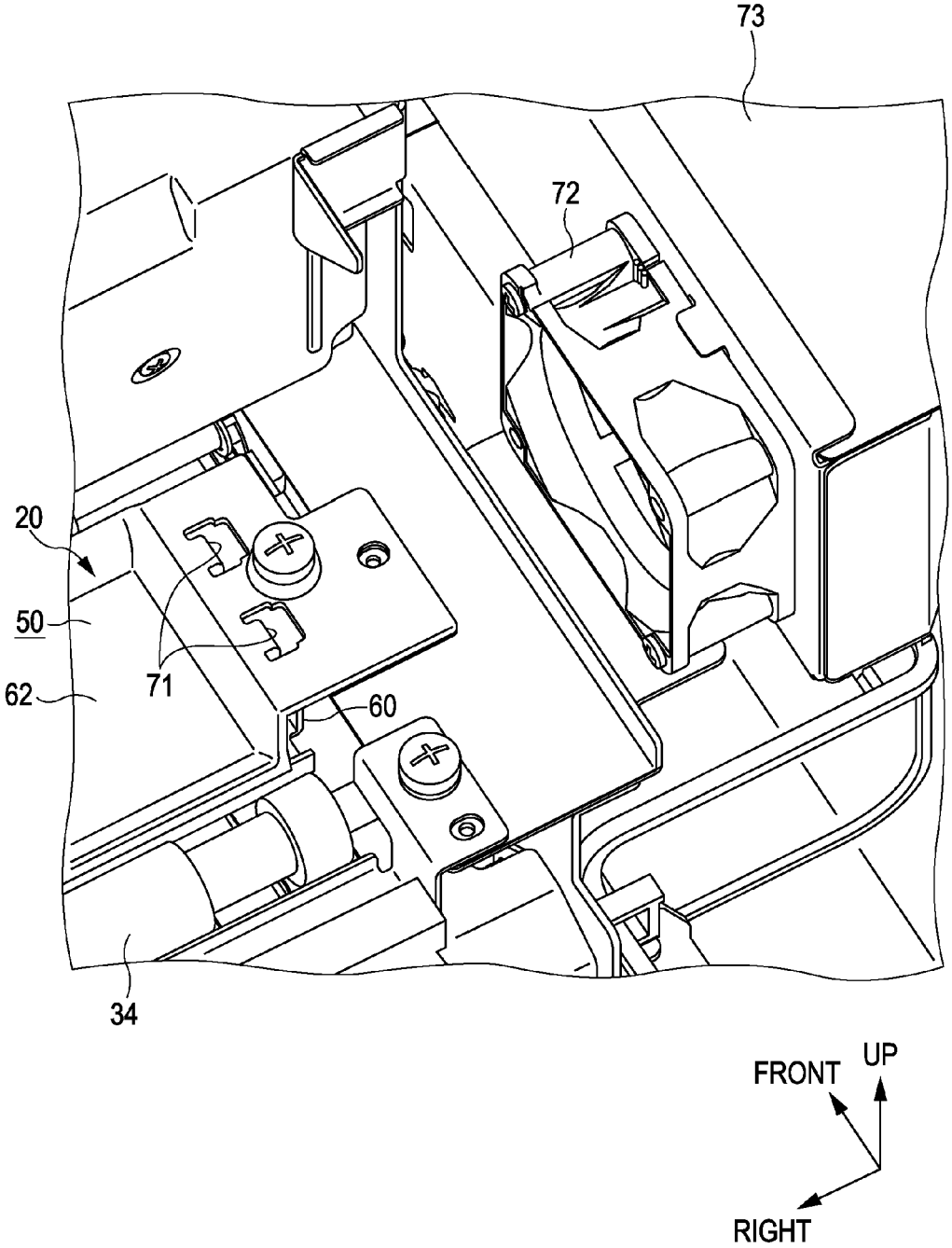
FIG. 5 is a partial enlarged perspective view of FIG. 2.

As illustrated in FIG. 2, FIG. 5, and FIG. 6, a pair of front and rear second openings 71 is formed on both of the right and left end portions of the cover member 62. That is to say, two second openings 71 opened at the upper side are formed on both of the right and left end portions of the cover member 62. The second openings 71 communicate with the passage T.

As illustrated in FIG. 2, FIG. 3, and FIG. 5, axial flow-type exhaust fans 72 as discharging units (airflow generation units) are arranged in the main body case 12 at both outer sides of the cover member 62 in the right-left direction. Rotating shafts of the exhaust fans 72 extend in the right-left direction. The exhaust fans 72 are arranged at slightly higher positions than the cover member 62 in the vicinity of the corresponding second openings 71. Exhaust ducts 73 having substantially rectangular parallelepiped shapes extending in the front-rear direction are arranged at outer sides of the exhaust fans 72 in the right-left direction.

The exhaust fans 72 are each mounted on an opening (not illustrated) at the upstream side, which is formed on an inner surface of each corresponding exhaust duct 73 on a rear end portion. The exhaust ducts 73 extend straightly from the exhaust fans 72 toward the front side as the direction of being farther from the liquid recording head 47 (see, FIG. 1). Openings (not illustrated) at the downstream side on the front ends of the exhaust ducts 73 abut against the front wall of the main body case 12.

In this case, the exhaust ducts 73 extend so as to be adjacent to the drying device 17 in the right-left direction. Further, a number of slits 74 are formed on the front wall of the main body case 12 at positions corresponding to the openings (not illustrated) at the downstream side on the front ends of the exhaust ducts 73. The slits 74 are arranged to have substantially rectangular shapes.

Further, if the exhaust fans 72 are driven, airflow flowing toward the exhaust fans 72 at both of the right and left end portions from the center portion in the right-left direction is generated in a region on the cover member 62. Therefore, the air between the drying device 17 and the liquid recording head 47 (see, FIG. 1) on the transportation path of the cut sheet CS (see, FIG. 1) is sucked by the exhaust fans 72 so as to be discharged to the outside of the transportation path. Further, the air which has been sucked by the exhaust fans 72 and discharged to the outside of the transportation path from the transportation path flows in the exhaust ducts 73 so as to be discharged to the exterior of the main body case 12 through the slits 74 in the front wall of the main body case 12.

Next, actions of the ink jet printer 11 are described.

Then, the surface print processing is performed on the sheet ST (continuous sheet), which has been fed out from the roll body RS of the sheet feeding portion 13 toward the downstream side of the transportation path, on the supporting table 48 by the liquid recording head 47. The sheet ST after the surface print processing is transported to the downstream side of the transportation path by the transportation roller pair R1 and is cut into the cut sheet CS (single sheet) by the cutter 16 sequentially. The cut sheet CS is transported to the back surface recording portion 20 by the transportation roller pair R2.

The surface (recording surface) of the cut sheet CS which has been transported to the back surface recording portion 20 is held by the strike receiving surfaces 61*a* of the holding members 61. Further, the back surface print processing is performed on the back surface of the cut sheet CS by striking of the striking recording head 51. At this time, the striking impact by the striking recording head 51 is received by the strike receiving surfaces 61*a* of the holding members 61 through the cut sheet CS. Then, the cut sheet CS after the back surface print processing is transported to a dry region as a region at the lower side of the drying device 17 by the transportation roller pair R3.

The cut sheet CS which has been transported to the dry region receives hot air to be blown out from the outlet 17*a* of the drying device 17 on the upper surface of the transportation path formation member 41 so as to be dried. The dried cut sheet CS is transported to the downstream side of the transportation path by the transportation roller pair R4 and curl of the cut sheet CS is corrected by the curl correcting mechanism 18. Thereafter, the cut sheet CS is discharged onto the sheet discharge portion 12*b* from the sheet discharge port 12*a*.

In this case, a part of the hot air blown out from the outlet 17*a* of the drying device 17 flows toward the rear side as the upstream side along the transportation path of the cut sheet CS. Then, the hot air flows in the following manner as indicated by arrows in FIG. 6. That is, the hot air flows on the cover member 62, and then, flows to the exhaust fans 72. Further, the hot air flows into the accommodating portion 69 of the cover member 62 through the first openings 70, and flows into the passage T through a space between the cover member 62 and the beam member 60. Moreover, the hot air flows in a circular manner around the rear side of the cover member 62 through a space between the lower surface of the beam member 60 and the cut sheet CS, and then, flows to the exhaust fans 72.

Then, the hot air flown into the accommodating portion 69 of the cover member 62 through the first openings 70 and another hot air flown into the passage T through the space between the cover member 62 and the beam member 60, flow to the right and left sides in the passage T and flow into the right and left exhaust fans 72 through the right and left second openings 71. At this time, the holding members 61 are heated by heat of the hot air flown into the accommodating portion 69 through the first openings 70. As a result, the strike receiving surfaces 61*a* are heated so that temperatures of the strike receiving surfaces 61*a* are increased.

Then, if the strike receiving surfaces 61*a* are heated, the cut sheet CS in a state where the surface thereof is wet with ink because the surface print processing has been performed on the cut sheet CS in the surface recording portion 15 is easy to be dried with the heat of the strike receiving surfaces 61*a* of the holding members 61 in the back surface recording portion 20. Then, since friction forces between the strike receiving surfaces 61*a* and the surface of the cut sheet CS are reduced, the cut sheet CS is transported on the back surface recording portion 20 smoothly.

Subsequently, the hot air flown into the exhaust fans 72 flows in the right and left exhaust ducts 73 so as to be discharged to the exterior of the main body case 12 through the slits 74 in the front wall of the main body case 12. At this time, the hot air flows in the exhaust ducts 73 so that the exhaust ducts 73 are heated. Then, a part of the heat of the heated exhaust ducts 73 returns to the dying device 17 so that drying efficiency by the drying device 17 is improved.

Thus, even when a part of the hot air to be blown out from the outlet 17*a* of the drying device 17 flows toward the rear side as the upstream side along the transportation path of the cut sheet CS, the hot air flows to the exhaust fans 72 so as to suppress flowing to the liquid recording head 47. Therefore, the heating of the liquid recording head 47 with the hot air is suppressed so that influence by the heat of the hot air on viscosity of ink or the like in the liquid recording head 47 is suppressed. Accordingly, since an ejection condition of ink through the nozzles 47*a* of the liquid recording head 47 is maintained, quality of the surface print processing on the surface of the sheet ST is ensured.

If the liquid recording head 47 is heated with the hot air, the ink viscosity or the like in the liquid recording head 47 is influenced and the ejection condition of ink through the nozzles 47*a* is changed. As a result, the quality of the surface print processing on the surface of the sheet ST is lowered in some cases.

The following effects can be obtained according to the embodiment as described in detail above.

1. Airflow for suppressing heat transfer from the drying device 17 to the liquid recording head 47 can be generated between the liquid recording head 47 and the drying device 17 by the exhaust fans 72. That is to say, the air (hot air) flowing into the liquid recording head 47 along the transportation path from the outlet 17*a* of the drying device 17 between the liquid recording head 47 and the drying device 17 on the transportation path can be discharged to the outside of the transportation path by the exhaust fans 72. Therefore, the heating of the liquid recording head 47 with heat of the hot air blown out from the outlet 17*a* of the drying device 17 can be suppressed. As a result, an ejection condition of ink through the nozzles 47*a* of the liquid recording head 47 can be maintained, thereby ensuring quality of the surface print processing on the surface of the sheet ST.

2. The cover member 62 has the first openings 70 and the second openings 71. Therefore, a part of the hot air blown out from the outlet 17*a* of the drying device 17 flows into the cover member 62 through the first openings 70 and heats the holding members 61. Thereafter, the hot air flows out to the outside of the cover member 62 through the second openings 71 and is discharged by the exhaust fans 72. Accordingly, the holding members 61 can be heated by the hot air blown out from the outlet 17*a* of the drying device 17 and the hot air flowing to the liquid recording head 47 can be suppressed.

It is to be noted that if the holding members 61 are heated, when the surface (recording surface) of the cut sheet CS in a state of being wet with ink because the surface print processing has been performed on the cut sheet CS in the surface recording portion 15 is held by the holding members 61, the surface of the cut sheet CS is easy to be dried with the heat of the holding members 61. Therefore, friction forces generated between the surface of the cut sheet CS and the strike receiving surfaces 61*a* of the holding members 61 can be reduced. Accordingly, the cut sheet CS on which the surface print processing has been performed in the surface recording portion 15 can be transported in the back surface recording portion 20 smoothly.

3. The exhaust ducts 73 extend from the exhaust fans 72 toward the front side as the direction of being farther from the liquid recording head 47. Therefore, the hot air which is discharged by the exhaust fans 72 can be made farther from the liquid recording head 47 reliably.

4. The exhaust ducts 73 are arranged so as to be adjacent to the drying device 17 in the right-left direction orthogonal to the transportation direction of the cut sheet CS. Therefore, the hot air having been blown out from the outlet 17*a* of the drying device 17 flows in the exhaust ducts 73 so that the exhaust ducts 73 are heated. Further, a part of the heat of the heated exhaust ducts 73 returns to the dying device 17, thereby improving drying efficiency of the drying device 17.

5. The holding members 61 include strike receiving surfaces 61*a* which receive impact of striking through the cut sheet CS when the back surface print processing is performed on the back surface of the cut sheet CS by the striking in a state of holding the surface (recording surface) of the cut sheet CS. Therefore, the impact of the striking by the striking recording head 51 when the back surface print processing is performed on the cut sheet CS can be received by the strike receiving surfaces 61*a* of the holding members 61. Accordingly, the back surface print processing can be preferably performed on the back surface of the cut sheet CS by the striking.

Variations

It is to be noted that the above embodiment may be changed to the following other embodiments.

The exhaust ducts 73 are not necessarily required to be arranged so as to be adjacent to the drying device 17 in the direction orthogonal to the transportation direction of the cut sheet CS.

The exhaust ducts 73 may not be provided. In this case, a configuration in which the air (hot air) flowing to the liquid recording head 47 along the transportation path from the outlet 17*a* of the drying device 17 between the liquid recording head 47 and the drying device 17 on the transportation path is discharged directly to the exterior of the main body case 12 by the exhaust fans 72 is required to be employed.

The exhaust ducts 73 are not necessarily required to extend from the exhaust fans 72 in the direction of being farther from the liquid recording head 47.

Any one of the two exhaust fans 72 may be omitted.

Either of the second openings 71 at the right and left sides of the cover member 62 may be omitted.

The back surface recording portion 20 may be omitted.

Instead of the exhaust fans 72, blowers which generate airflow for discharging the air (hot air) flowing to the liquid recording head 47 along the transportation path from the outlet 17*a* of the drying device 17 between the liquid recording head 47 and the drying device 17 on the transportation path to the outside of the transportation path may be used as the airflow generation units. In this case, the airflow generated by the blowers is made to collide with the hot air which tries to flow to the liquid recording head 47 along the transportation path from the outlet 17*a* of the drying device 17 so that the hot air is prevented from flowing to the liquid recording head 47.

Instead of the exhaust fans 72, air curtains which are provided so as to suppress (restrict) flowing of the hot air from the drying device 17 to the liquid recording head 47 may be used as the airflow generation units. In this case, the drying device 17 and the liquid recording head 47 are partitioned by the air curtains.

The drying device 17 may not be a type of the drying device which dries the cut sheet CS with the hot air but be a type of a drying device which dries the cut sheet CS with radiation heat of a heater.

A member other than the drying device 17 may be used as a heat source. That is to say, when ultraviolet curable ink is used in the ink jet printer 11, an ultraviolet irradiation device is used instead of the drying device 17. In this case, the ultraviolet irradiation device includes a high-pressure ultraviolet lamp (for example, high-pressure mercury ultraviolet lamp or metal halide ultraviolet lamp) of which temperature is increased. Therefore, the high-pressure ultraviolet lamp functions as a heat source.

Each of the holding members 61 is not necessarily required to include the strike receiving surface 61*a*. That is to say, each of the holding members 61 may be a guide member which guides the surface (recording surface) side of the cut sheet CS to be transported.

The sheet ST and the cut sheet CS constituting the target may be a plastic film or a metal foil.

In the above-described embodiments, the recording apparatus is embodied as the ink jet printer 11. However, a liquid ejecting apparatus which ejects and discharges liquid other than ink may be employed. The invention can be applied to various types of liquid ejecting apparatuses including a liquid ejecting head or the like which discharges minute liquid droplets. Note that the terminology "liquid droplet" represents a state of liquid which is discharged from the above liquid ejecting apparatus. For example, a granule form, a teardrop form, and a form that pulls tails in a string-like form therebehind are included as the liquid droplets. The terminology "liquid" here represents materials which can be ejected by the liquid ejecting apparatus. For example, any materials are included as long as the materials are in a liquid phase. For example, materials in a liquid state having high or low viscosity or a fluid state such as sol, gel water, other inorganic solvents, an organic solvent, a solution, a liquid resin or a liquid metal (metallic melt) can be included as the liquid. Further, the liquid is not limited to liquid as one state of a material, and includes a material in which the particles of a functional material made of solid matter such as pigments, metal particles or the like are dissolved, dispersed or mixed in a solvent, and the like. Typical examples of the liquid are ink described in the above embodiments and liquid crystals. The terminology "ink" here encompasses common aqueous ink and oil ink, and various liquid compositions such as gel ink, hot melt ink and so on. Specific examples of the liquid ejecting apparatus include a liquid ejecting apparatus which ejects liquid in which a material such as an electrode material or a coloring material is included in a dispersed or dissolved state. The material such as an electrode material or a coloring material are used for manufacturing liquid crystal displays, electroluminescence (EL) displays, surface emitting displays and color filters, for example. Further, the specific examples of the liquid ejecting apparatus include a liquid ejecting apparatus which ejects a bioorganic material used for manufacturing biochips, a liquid ejecting apparatus which is used as a precision pipette and ejects liquid to be used as a sample, printing equipment, a micro-dispenser and so on. Other examples of the liquid ejecting apparatus include a liquid ejecting apparatus which pinpoint-ejects lubricating oil to a precision machine such as a watch, a camera and the like. Further, a liquid ejecting apparatus which ejects a transparent resin liquid such as an ultraviolet curable resin or the like onto a substrate in order to form a hemispherical micro-lens (optical lens) used in an optical communication element and the like, is included as the liquid ejecting apparatus. In addition, a liquid ejecting apparatus which ejects an acid or alkali etching liquid for etching a substrate or the like may be employed as the liquid ejecting apparatus. The invention can be applied to any type of these liquid ejecting apparatuses.

What is claimed is:

1. A recording apparatus comprising:

a liquid recording unit that is arranged at a halfway position of a transportation path of a target to be transported to a downstream side from an upstream side, and performs liquid record processing by adhering liquid to the target;

a heat source that is arranged so as to be spaced from the liquid recording unit on the transportation path; and an airflow generation unit that generates airflow for suppressing heat transfer from the heat source to the liquid recording unit between the liquid recording unit and the heat source, wherein the airflow generation unit provides some of the heat generated by the heat source to a holding member configured to hold the target in the transportation path to thereby heat the holding member while still suppressing the heat transfer to the liquid recording unit.

2. The recording apparatus according to claim 1, wherein the airflow generation unit is a discharging unit that is arranged at an outer side of the transportation path in a direction orthogonal to a transportation direction of the target and discharges air between the liquid recording unit and the heat source on the transportation path to an outside of the transportation path.

3. The recording apparatus according to claim 2, wherein the holding member which holds a recording surface of the target as a surface on which the liquid record processing is performed and has a strike receiving surface for receiving impact of striking through the target when striking record processing by the striking is performed on a surface opposite to the recording surface, and a cover member which covers the holding member and has a first opening at a side of the heat source in the transportation direction of the target, are provided between the heat source and the liquid recording unit on the transportation path, and wherein a second opening is provided at least an end of the cover member at a side corresponding to the discharging unit in both ends in the direction orthogonal to the transportation direction of the target.

4. The recording apparatus according to claim 2, further including an exhaust duct that introduces the air which is discharged to the outside of the transportation path by the discharging unit to an exterior, wherein the exhaust duct extends from the discharging unit in a direction of being farther from the liquid recording unit.

5. The recording apparatus according to claim 4, wherein the heat source is a drying unit which blows heated air onto the target on which the liquid record processing has been performed by the liquid recording unit to dry the target, and the exhaust duct is arranged so as to be adjacent to the drying unit in the direction orthogonal to the transportation direction of the target.

* * * * *